United States Patent [19]

Ohno

[11] 4,183,678

[45] Jan. 15, 1980

[54] AGITATING MIXING APPARATUS

[76] Inventor: Ietatsu Ohno, 1-2, 1-chome, Kasuya, Setagaya-ku, Tokyo, Japan

[21] Appl. No.: 861,212

[22] Filed: Dec. 16, 1977

Related U.S. Application Data

[63] Continuation of Ser. No. 717,009, Aug. 23, 1976, abandoned.

[51] Int. Cl.[2] ..... B01F 9/08

[52] U.S. Cl. ..... 366/224

[58] Field of Search ..... 366/222-226, 366/230, 231, 234, 236

[56] References Cited

U.S. PATENT DOCUMENTS

| | | | |
|---|---|---|---|
| 81,896 | 9/1868 | Haigh | 366/222 |
| 941,267 | 11/1909 | McRae | 366/230 |
| 2,652,983 | 9/1953 | Hall | 366/224 X |
| 3,380,671 | 4/1968 | Kubodera | 366/222 X |
| 3,387,828 | 6/1968 | Bosche | 366/224 |

FOREIGN PATENT DOCUMENTS

| | | | |
|---|---|---|---|
| 748133 | 10/1944 | Fed. Rep. of Germany | 366/225 |
| 1062222 | 7/1959 | Fed. Rep. of Germany | 366/224 |

*Primary Examiner*—Philip R. Coe

*Attorney, Agent, or Firm*—Laurence R. Brown

[57] ABSTRACT

An agitating mixing apparatus wherein a cylindrical or polygonal tank is fitted as inclined at a proper angle to a rotary shaft and agitation and mixing accelerating blades of any shapes and angles are provided within the tank so as to respectively separately operate to cause a centrifugal flow, rotary flow, diagonal flow and 8-shaped flow to things to be mixed.

1 Claim, 9 Drawing Figures

FIG.1
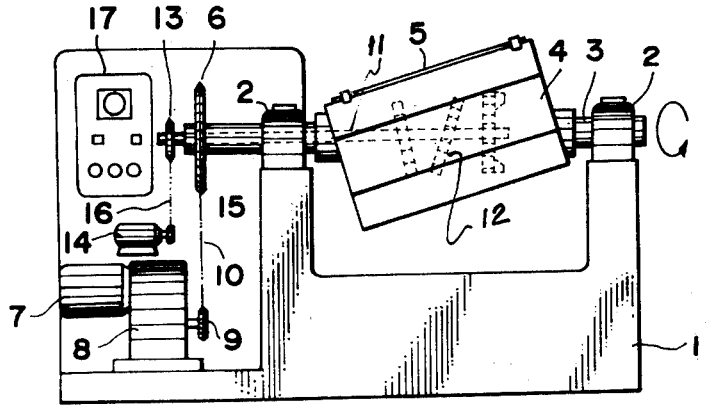
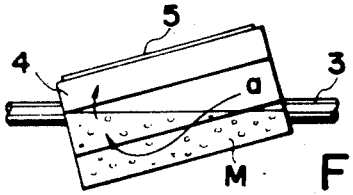
FIG.2A
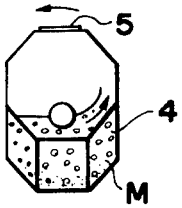
FIG.2E
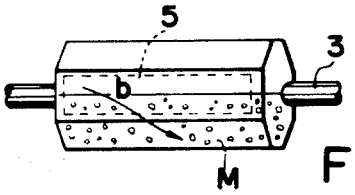
FIG.2B
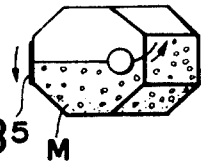
FIG.2F
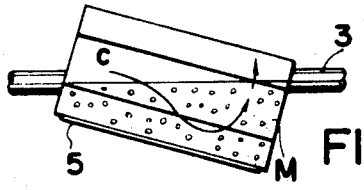
FIG.2C
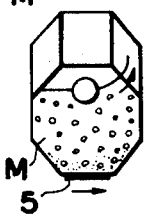
FIG.2G
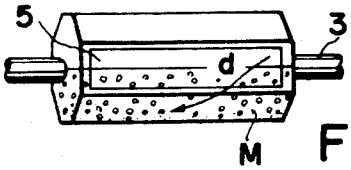
FIG.2D
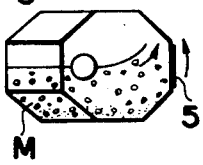
FIG.2H

AGITATING MIXING APPARATUS

This is a continuation of application Ser. No. 717,009 filed Aug. 23, 1976, and now abandoned.

This invention relates to agitating mixing apparatus and more particularly to an agitating mixing apparatus of a system of rotating a container.

There are already various kinds of agitating mixing apparatus of this type of rotating containers but none of them can be expected to have a perfect agitating mixing effect. Therefore, there has been none adapted to agitate and mix all of such things as powders and solids.

An object of the present invention is to provide an apparatus wherein a cylindrical or polygonal tank is fitted as inclined to a shaft so that, when any rotation is given to the tank, all of a centrifugal flow, rotary flow, diagonal flow and 8-shaped flow will be caused to things to be mixed within the tank and further agitation and mixing accelerating blades are to be rotated independently within the tank to accelerate the agitation and mixing to thus eliminate such conventional defects.

FIG. 1 is a side view of an embodiment of the apparatus according to the present invention.

FIG. 2 A to D are side views showing flowing states of things to be mixed in case the blades of the apparatus in FIG. 1 are removed.

FIG. 2 E to H are respectively elevations of FIG. 2 A to D.

FIG. 2, E, F, G and H correspond respectively to FIG. 2 A, B, C and D.

A rotary shaft 3 is horizontally rotatably held by a pair of bearings 2 provided on a mount body 1. A cylindrical or polygonal tank 4 is fixed on the end surfaces at a proper angle of inclination to the middle part of said rotary shaft. The tank 4 is provided with an opening and closing lid 5 for putting in and taking out several kinds of materials to be agitated and mixed and is made to be sealed as required. Further, a drive gear or pulley 6 is fixed to one end of the rotary shaft 3. A motor 7 fitted to the mount body 1 can have the number of revolutions freely varied with a speed change gear 8. A chain or belt 10 for power transmission is connected between a gear or pulley 9 fitted to the shaft of the motor and the above mentioned drive gear or pulley 6. A rotary shaft 11 extending into the tank 4 through the rotary shaft 3 is provided to fit blades 12 for accelerating agitation and mixing. The blade 12 is of any shape adapted to things to be mixed. A drive gear or pulley 13 is provided at the other end of the rotary shaft 11 and is connected with a gear or pulley 15 provided on a motor 14 through a chain or belt 16. 17 is a controlling switchboard.

The present invention is of such formation. First of all, in case the blades 12 for accelerating agitation and mixing are not fitted, when the motor 7 is started to rotate the tank 4 in the direction indicated by the arrow, the flowing states of the contents will be as shown in FIG. 2 showing the movements of the body M to be mixed in the positions rotated by 45 degrees in turn. That is to say, the body M to be mixed will flow to reciprocate diagonally by describing the shape of the numeral "8" as shown by the arrows a, b, c and d in the axial direction of the tank 4.

Therefore, if the blades 12 are also rotated against such flows of the body of be mixed, the body M will be accelerated to be agitated and mixed more complicately and will be able to be agitated and mixed smoothly at a high efficiency.

As explained above, according to the apparatus of the present invention, as the tank if fitted as inclined to the rotary shaft and is rotated, the things to be mixed will make such complicated movements as an 8-shaped flow in the axial direction, a diagonal flow and rotary and centrifugal flows in the outer peripheral direction and will be accelerated to be further agitated and mixed by the blades. All of such things as powders and liquids can be agitated and mixed and further the same or different things of the same or different granularities can be also agitated and mixed.

I claim:

1. An agitating mixing apparatus comprising two rotary shafts separately rotatable independently of each other, one of which said rotary shafts extends through and is coaxial with the other, and a hollow longitudinal tank adapted to hold various kinds of materials characterized by two opposite planar closed ends thereby defining said longitudinal tank having a body with corners at the meeting of said closed ends with a longitudinal container wall body, means affixed to said two closed ends mounting said tank at a fixed angle to one said rotary shaft to rotate therewith with all the tank corners gyrating about the shaft axis, agitation and mixing accelerating blades fitted within said tank longitudinally along the one of said rotary shafts which extends through the other rotary shaft, separate means for rotating respectively said two rotary shafts independently of each other at variable speeds to affect rotation of said tank and said blades by said rotary shafts in a manner related to said mounting angle whereby the materials in said tank are caused to reciprocate diagonally about the blades in a figure 8 pattern.

* * * * *